US010892550B2

(12) United States Patent
Topak

(10) Patent No.: US 10,892,550 B2
(45) Date of Patent: Jan. 12, 2021

(54) CROSS-SHAPED ANTENNA ARRAY

(71) Applicant: Sony Corporation, Tokyo (JP)

(72) Inventor: Ali Eray Topak, Stuttgart (DE)

(73) Assignee: SONY CORPORATION, Tokyo (JP)

( * ) Notice: Subject to any disclaimer, the term of this patent is extended or adjusted under 35 U.S.C. 154(b) by 468 days.

(21) Appl. No.: 15/592,282

(22) Filed: May 11, 2017

(65) Prior Publication Data

US 2017/0365924 A1 Dec. 21, 2017

(30) Foreign Application Priority Data

Jun. 16, 2016 (EP) ..... 16174809

(51) Int. Cl.
*H01Q 3/36* (2006.01)
*H01Q 21/06* (2006.01)
*H01Q 25/00* (2006.01)

(52) U.S. Cl.
CPC ..... *H01Q 3/36* (2013.01); *H01Q 21/061* (2013.01); *H01Q 25/002* (2013.01)

(58) Field of Classification Search
CPC ..... H01Q 21/061; H01Q 1/38; H01Q 9/0407; H01Q 3/26; H01Q 1/246; H01Q 21/28; H01Q 21/06; H01Q 21/245; H01Q 21/00–12; H01Q 21/24; H01Q 21/10; H01Q 13/206; H01Q 21/065; H01Q 21/0075
USPC ..... 343/893, 702, 725, 737, 876
See application file for complete search history.

(56) References Cited

U.S. PATENT DOCUMENTS

H375 H * 11/1987 Dinger ..... H01Q 3/26 342/372
4,937,585 A * 6/1990 Shoemaker ..... H01Q 3/36 343/700 MS
10,320,087 B2 * 6/2019 Miraftab ..... H01Q 21/30
2009/0315792 A1 * 12/2009 Miyashita ..... H01Q 1/243 343/742
2010/0060521 A1 3/2010 Hayes et al.
2011/0148727 A1 * 6/2011 Chang ..... H01Q 13/20 343/777
2013/0201060 A1 8/2013 Livneh et al.
2015/0325926 A1 11/2015 Topak et al.
(Continued)

FOREIGN PATENT DOCUMENTS

CN 101501928 A 8/2009
WO 2015/139294 A1 9/2015

OTHER PUBLICATIONS

Rafael H. Medina-Sanchez, "Beam Steering Control System for Low-Cost Phased Array Weather Radars: Design and Calibration Techniques", Doctoral Dissertations, Dissertations and Theses, 2014, 220 pgs.

(Continued)

*Primary Examiner* — Ricardo I Magallanes
(74) *Attorney, Agent, or Firm* — Xsensus LLP

(57) ABSTRACT

A cross-shaped antenna array comprises a first linear array of first radiation elements, a second linear array of second radiation elements, wherein said second linear array is arranged substantially perpendicular to said first linear array, a common radiation element arranged at the intersection of said first linear array and said second linear array, and a feed port at each end of said first and second linear arrays for reception of a feed signal.

14 Claims, 8 Drawing Sheets

(56) References Cited

U.S. PATENT DOCUMENTS

| | | | | |
|---|---|---|---|---|
| 2016/0036135 | A1 | 2/2016 | Hellinger et al. | |
| 2017/0012363 | A1* | 1/2017 | Zou | H01Q 21/061 |

OTHER PUBLICATIONS

S. Shynu et al., "Reconfigurable Antenna with Elevation and Azimuth Beam Switching", Antenna & High Frequency Research Centre, 2010, 5 pgs.

Chinese Office Action dated May 20, 2020, issued in corresponding Chinese Patent Application No. 201710445688.

* cited by examiner

CROSS-SHAPED ANTENNA ARRAY

BACKGROUND

Field of the Disclosure

The present disclosure relates to a cross-shaped antenna array, an antenna device and a method of operating such an antenna array.

Description of Related Art

Recently, 2D electronic beamforming systems are becoming more popular for consumer-type radar and communication products. Phased arrays are an interesting beamforming technique, used for shaping and steering the main antenna beam electronically to certain directions within the predefined field of view. The phased array technology has been the key antenna system for satellite communications and military radar for decades. However, despite its high functional performance, it is still a very costly and complex solution for emerging wireless consumer applications such as high speed wireless communication and driving assistance systems due to the number of phase shifter, variable gain amplifier and their complex control circuitry for dynamic calibration.

Current automotive radar manufacturers would like to bring more functionality to their products, such as 2D electronic beamforming in elevation and azimuth. Alternatively, multi-mode radar products are attracting much more attention of the custom-ers, which is used for multiple purposes at the same time.

The "background" description provided herein is for the purpose of generally presenting the context of the disclosure. Work of the presently named inventor(s), to the extent it is described in this background section, as well as aspects of the description which may not otherwise qualify as prior art at the time of filing, are neither expressly or impliedly admitted as prior art against the present disclosure.

SUMMARY

It is an object to provide a cross-shaped antenna array, an antenna device and a method of operating such an antenna array, which enable 2D beamforming.

According to an aspect there is provided a cross-shaped antenna array is presented comprising:

- a first linear array of first radiation elements,
- a second linear array of second radiation elements, wherein said second linear array is arranged substantially perpendicular to said first linear array,
- a common radiation element arranged at the intersection of said first linear array and said second linear array, and
- a feed port at each end of said first and second linear arrays for reception of a feed signal.

According to a further aspect there is provided an antenna device comprising:

- a cross-shaped antenna array as disclosed herein, and
- a signal source for generating a feed signal and for providing said feed signal to said feed ports.

According to further aspect there is provided a method of operating an antenna array as disclosed herein, said method comprising:

- generating a feed signal,
- providing said feed signal to one or more feed ports of said antenna array, thereby controlling to which of said feed ports the feed signal is provided and controlling the phase of the feed signal before providing it to said one or more feed ports.

Embodiments of the invention are defined in the dependent claims. It shall be understood that the claimed method and antenna device have similar and/or identical preferred embodiments as the claimed antenna array, in particular as defined in the dependent claims and as disclosed herein.

One of the aspects of the disclosure is to provide a cross-shaped (also called plus-shaped) antenna array that enables the superposition of two or more (e.g. four) squinted antenna beams caused by two or more feed signals, as exciting signals, that are simultaneously provided to the different feed ports. By controlling these feed signals many different antenna beams can be achieved so that the antenna beam can be steered to several directions in elevation and azimuth electronically. The disclosed 2D cross-shaped antenna topology can be used as transceiver, transmitter or receiver antenna.

Antenna beams with different polarizations (vertical/horizontal linearly polarized, circularly polarized, etc.) can be generated, which may provide extra information regarding classification/identification of multiple targets in different scenarios.

Optionally, a variable phase shifter may be provided at each feed port, but additional variable gain amplifiers are generally not required.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
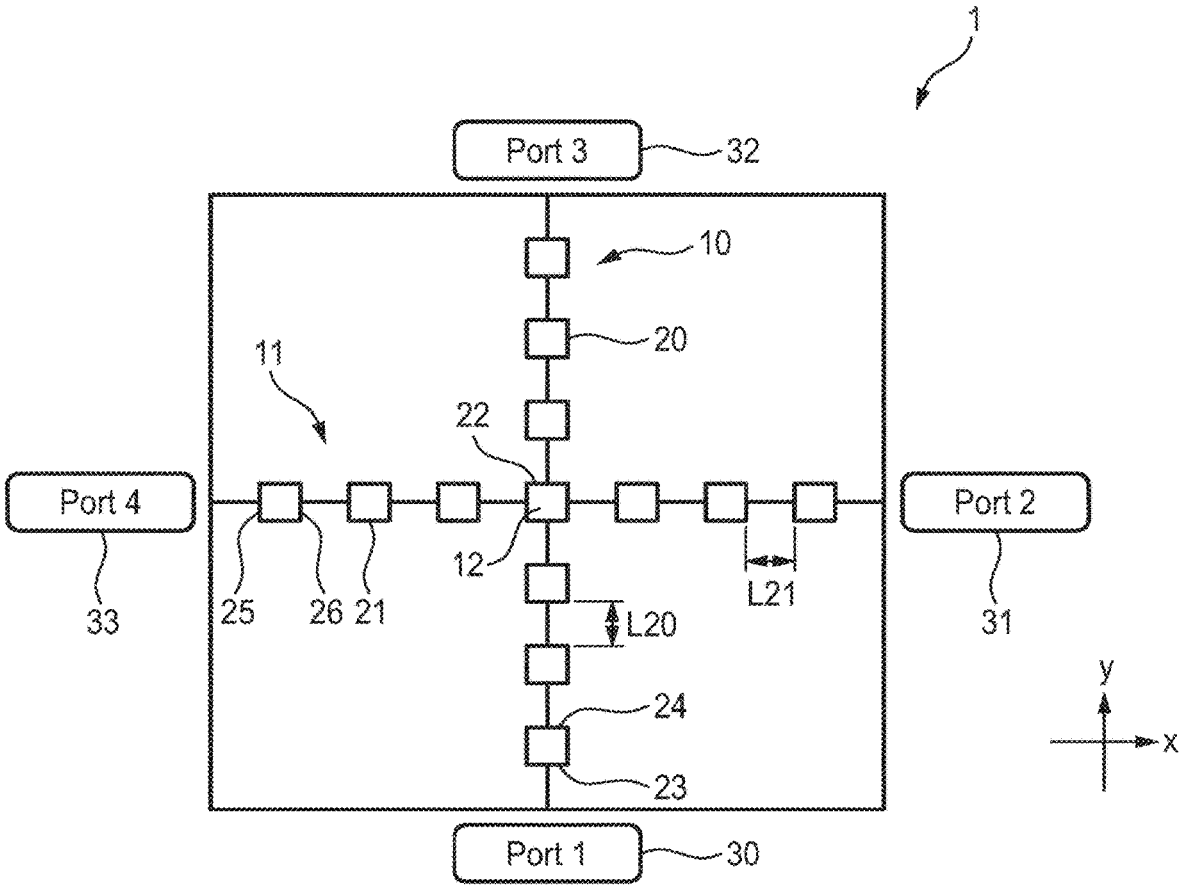
FIG. 1 shows a top view of an embodiment of a cross-shaped antenna array according to the present disclosure.

Referring now to the drawings, wherein like reference numerals designate identical or corresponding parts throughout the several views, FIG. 1 shows a top view of a first embodiment of a cross-shaped antenna array 1 according to the present disclosure. It comprises a first linear array 10 of first radiation elements 20 and a second linear array 11 of second radiation elements 21. The second linear array 11 is arranged in substantially the same plane as said first linear array 10 and substantially perpendicular to said first linear array 10, i.e. they form a cross. In the center of the cross, i.e. at the intersection 12 of said first linear array 10 and said second linear array 11, a common radiation element 22, which may be considered as belonging to both linear arrays 10 and 11. Further, a feed port 30, 31, 32, 33 is provided at each end 13, 14 of said first and second linear arrays 10, 11 for reception of a feed signal. This 2D cross-shaped antenna array 1 can be used for steering the generated antenna beam to several directions in elevation and azimuth electronically.

The radiation elements may be configured as patch antenna elements (e.g. placed on an RF substrate) or a slotted waveguides (e.g. as hollow metallic waveguides) or SIW (substrate-integrated-waveguide, e.g. placed on an RF substrate) type slot arrays, which are some of the antenna topologies, which can be used for this cross-shape architecture. This antenna topology does not have isolation problems due to enough spacing among the feed ports.

In the embodiment shown in FIG. 1, each linear array 10, 11 comprises seven radiation elements 20, 21 (including the central radiation element 22). However it is possible that they have another number of radiation elements, and it is also possible that the linear array 10 has a different number of radiation elements than the linear array 11.

Figure 2:
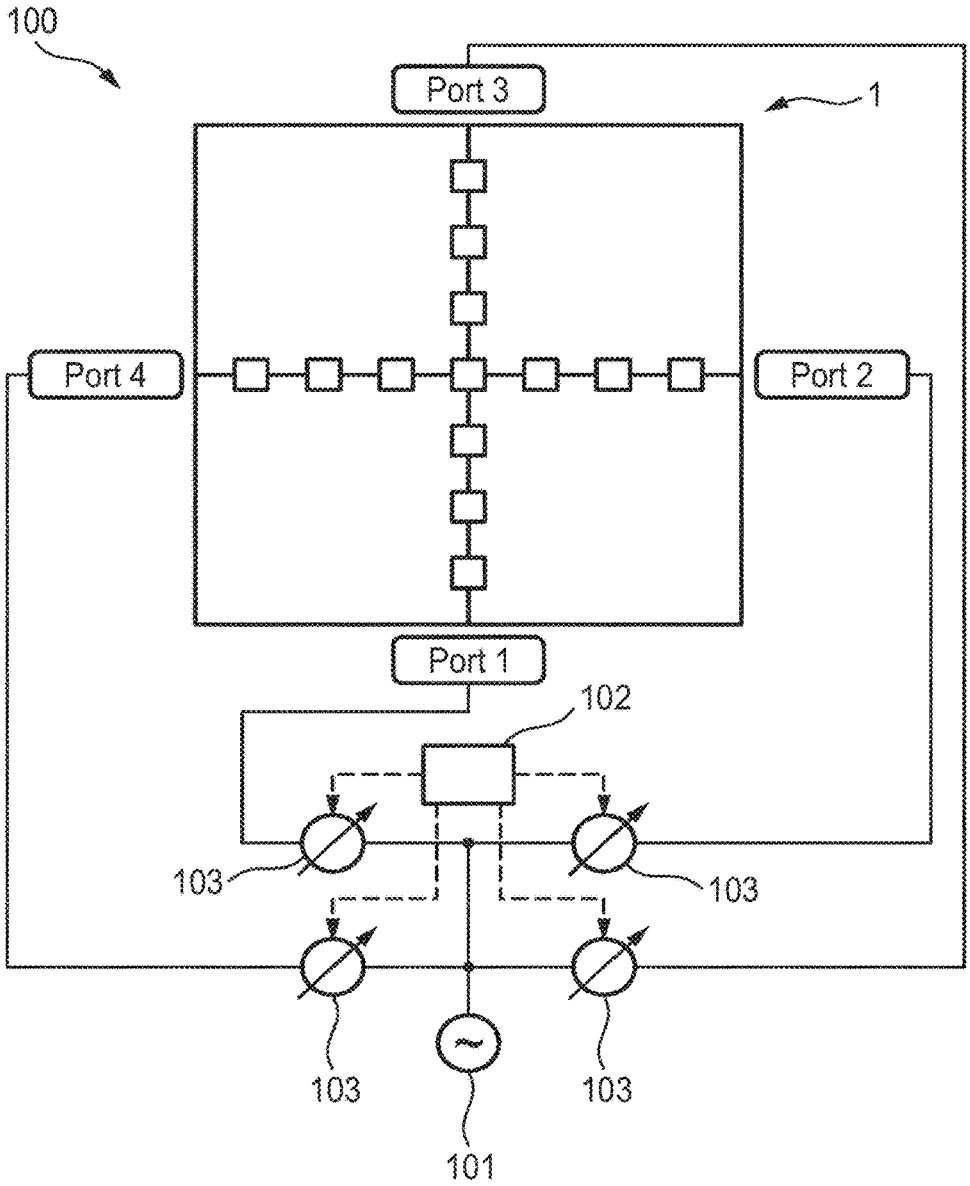
FIG. 2 shows an embodiment of an antenna device according to the present disclosure.

FIG. 2 shows an embodiment of an antenna device 100 according to the present disclosure. It comprises a cross-shaped antenna array as disclosed herein, e.g. the antenna array 1 as shown in FIG. 1, and a signal source 101, e.g. a controllable oscillator, for generating a feed signal and for providing said feed signal to said feed ports 30, 31, 32, 33.

In order to steer the antenna beam to different directions, these ports can in one embodiment individually be turned on and off, or it can be controlled to which of the feed ports 30, 31, 32, 33 (e.g. to only one, or two, or three, or all) the feed signal is provided. For this purpose, the antenna device 100 may optionally comprise a controller 102.

Further, it may optionally be possible to switch the input phases of the feed ports, preferably at least between 0° and 180°. For example, current commercial radar front-ends are capable of providing these properties on a chip level. For this purpose, the antenna device 100 may optionally further comprise a variable phase shifter 103 at one or more feed ports 30, 31, 32, 33. The variable phase shifter(s) 103 may also be controlled by the controller 102 or a separate controller. Generally, the variable phase shifter(s) 103 may be configured to control the input phases of the feed ports to any phase value between 0° and 360°, thus providing even more flexibility in the two-dimensional control of the direction of the resulting antenna beam.

It is thus possible in an embodiment to control (e.g. by the controller 102) to which of said feed ports the feed signal is provided and/or which of the feed ports 30, 31, 32, 33 is switched on and which is switched off (e.g. digitally). Further, by use of e.g. the controller 102 it may be possible to control the phase of the feed signal before providing it to said one or more feed ports 30, 31, 32, 33.

Figure 3:
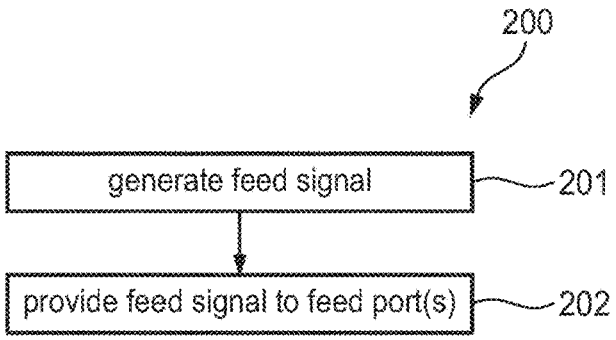
FIG. 3 shows a flow chart of a method according to the present disclosure.

FIG. 3 shows a flow chart of a method 200 according to the present disclosure. In a first step 201 a feed signal is generated. In a second step 202 said feed signal is provided to one or more feed ports of said antenna array, thereby controlling to which of said feed ports the feed signal is provided and controlling the phase of the feed signal before providing it to said one or more feed ports.

If x direction refers to azimuth and y direction refers to elevation, the antenna beam can be steered to multiple different directions. Using the disclosed cross-shaped array antenna configuration, the antenna beam can be tilted to many directions, in particular tilted up, down, right, left, upper right, down right, upper left, and down left. If electromagnetic signals (i.e. feed signals) are supplied from different feed ports with an additional 180° phase shift values, many different beams can be obtained including dual or quad-antenna beams or broadside beams with different half power beam widths (HPBW). If the feed signal is provided to more than one feed port, the superposition of the individual antenna beams (resulting from each individual feed signals provided to a single feed port) is observed as a final antenna beam.

In an embodiment a first spacing L20 between the respective first radiation elements 10 are all identical and a second spacing L21 between the respective second radiation elements 21 are all identical. Further, in an embodiment the first spacing L20 may be identical to the second spacing L21, but can generally also be different. These spacings among radiating elements determine the maximum direction of a steerable beam.

With the disclosed cross-shaped antenna array it further possible to provide different antenna polarizations based on the feed ports used. If ports 30, 32 of the linear array 10 are used, then vertical polarization is observed (since basically the (in the figure) horizontally aligned edges 23 and 24 of the radiation elements 20 contribute to the antenna beam generated by the linear array 10). If ports 31, 33 of the linear array 11 are used, then horizontal polarization is observed (since basically the (in the figure) vertically aligned edges 25 and 26 of the radiation elements 21 contribute to the antenna beam generated by the linear array 11). If all ports 30-33 from the linear arrays 10 and 11 are used, then circular polarization is observed.

If any single one of these feed ports 30-33 is used for feeding the signal to the antenna, the antenna works like a traveling wave antenna (i.e. a frequency dependent antenna). In the following table the relationship between the operating frequency and the beam direction can be found. The propagation of the electromagnetic signals at the intersection of two linear arrays is such that, for example, if the horizontal linear array 11 is employed, the electromagnetic signals are propagating along the radiating elements of this linear array 11. Due to radiating element 12, the electromagnetic signals are not split into three, but propagates further only in azimuth (x) direction.

| Frequency | Direction | Frequency | Direction |
|---|---|---|---|
| $L_f$ = 1.5 mm | | $L_f$ = 1.35 mm | |
| 75 GHz | 12° | 75 GHz | 7° |
| 76 GHz | 13° | 76 GHz | 8° |
| 77 GHz | 14° | 77 GHz | 10° |
| 78 GHz | 16° | 78 GHz | 12° |
| 79 GHz | 18° | 79 GHz | 13° |
| 80 GHz | 19° | 80 GHz | 14° |
| 81 GHz | 21° | 81 GHz | 15° |

The functionality of the disclosed cross-shaped array topology has been proven through simulation. The cross-shaped linear array topology is not restricted to certain numbers of linear array or radiation elements per array. For instance, the cross may be formed by two (or more) vertically arranged linear arrays and two (or more) horizontally arranged linear arrays. Further, the angle between the linear arrays needs not necessarily to be 90°, but may also be smaller or larger, e.g. in a range between 45° and 135°. Still further, more than two linear arrays may be arranged in star form. Generally, many different antenna topologies can be employed for 2D beam steering.

The disclosed antenna topology provides that, contrary to conventional phased antenna arrays, it is not sensitive but very robust to operating frequency (e.g. approx. 1 GHz) amplitude (e.g. approx. 10%) and phase errors (e.g. approx.

±15°). It allows 2D beamforming in azimuth and elevation directions, using e.g. single, dual or quad antenna beams. Further, it enables the generation of a fan-shaped or a pencil-shaped antenna beam. Further, the antenna array can be built rather compact and allows the generation of horizontally, vertically and circularly polarized antenna beams.

Figure 4:
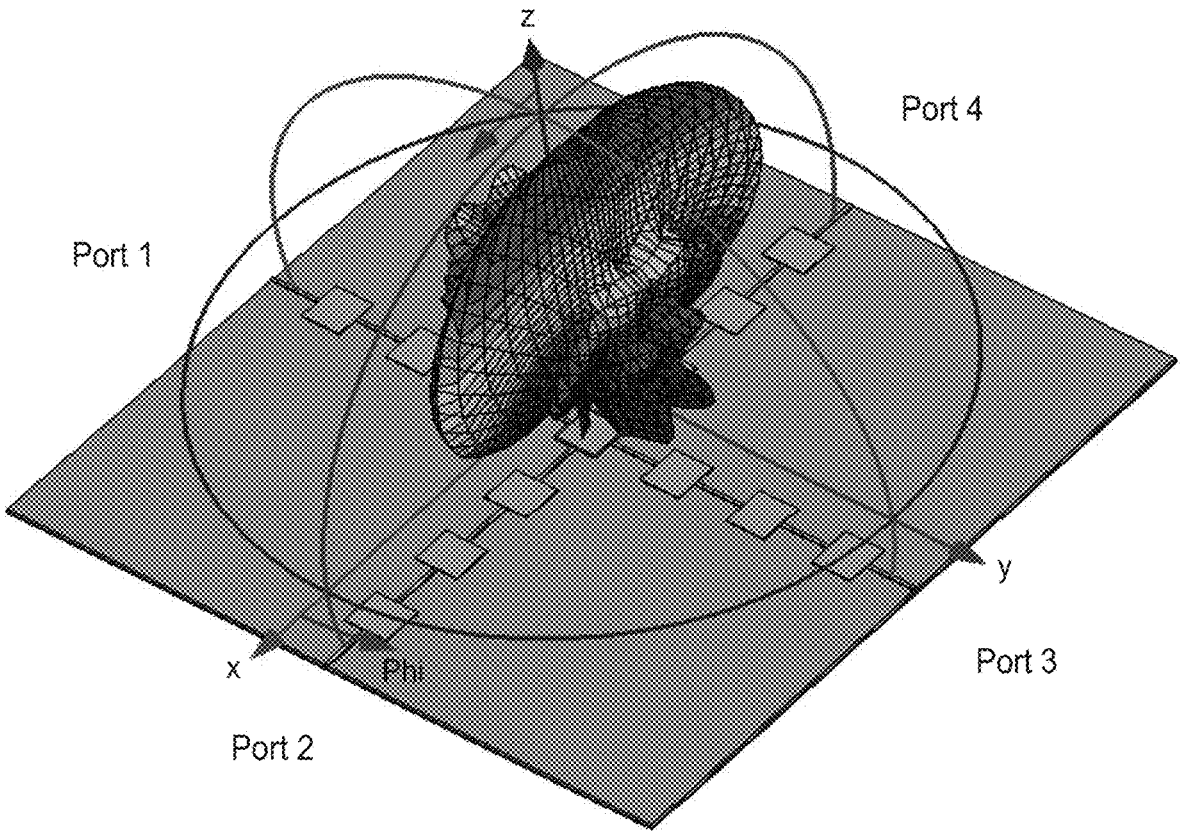
FIGS. 4 to 9 show exemplary antenna beam patterns achievable with the cross-shaped antenna array according to the present disclosure.
Figure 5:
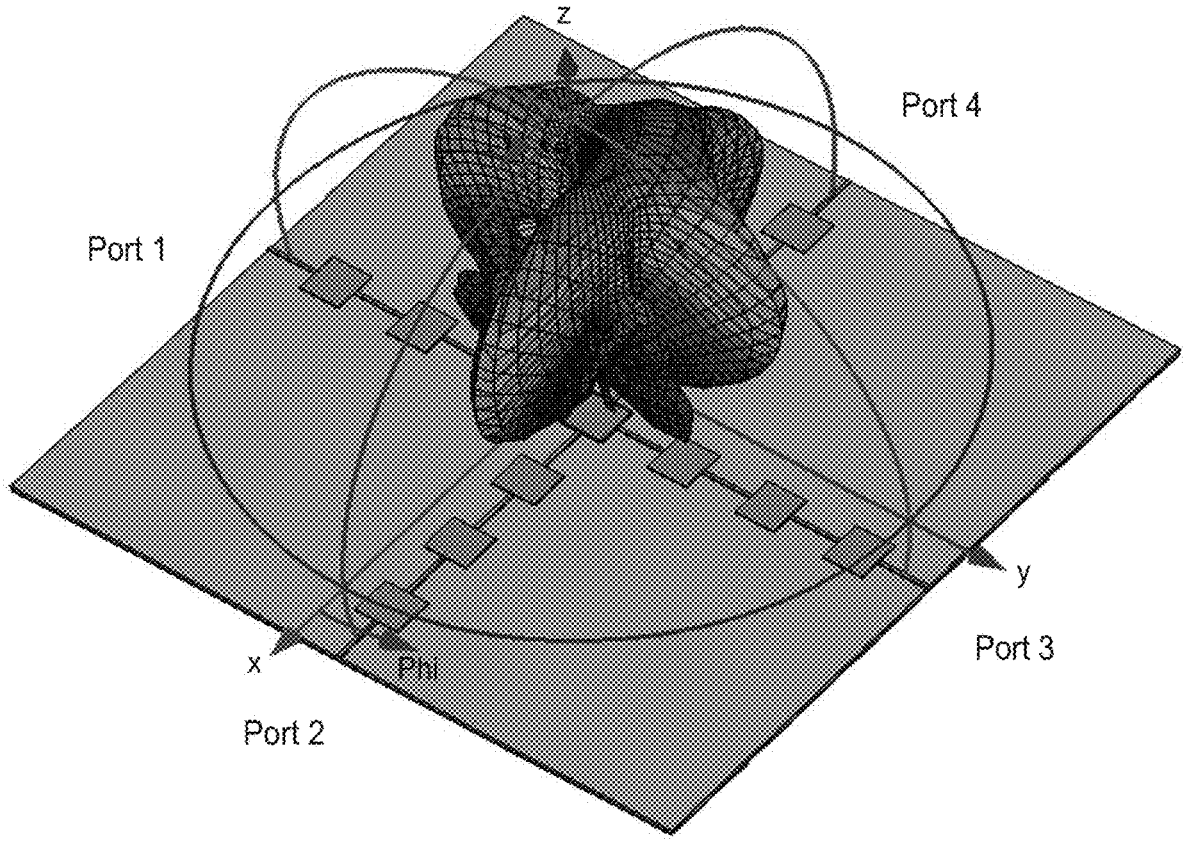
Figure 6:
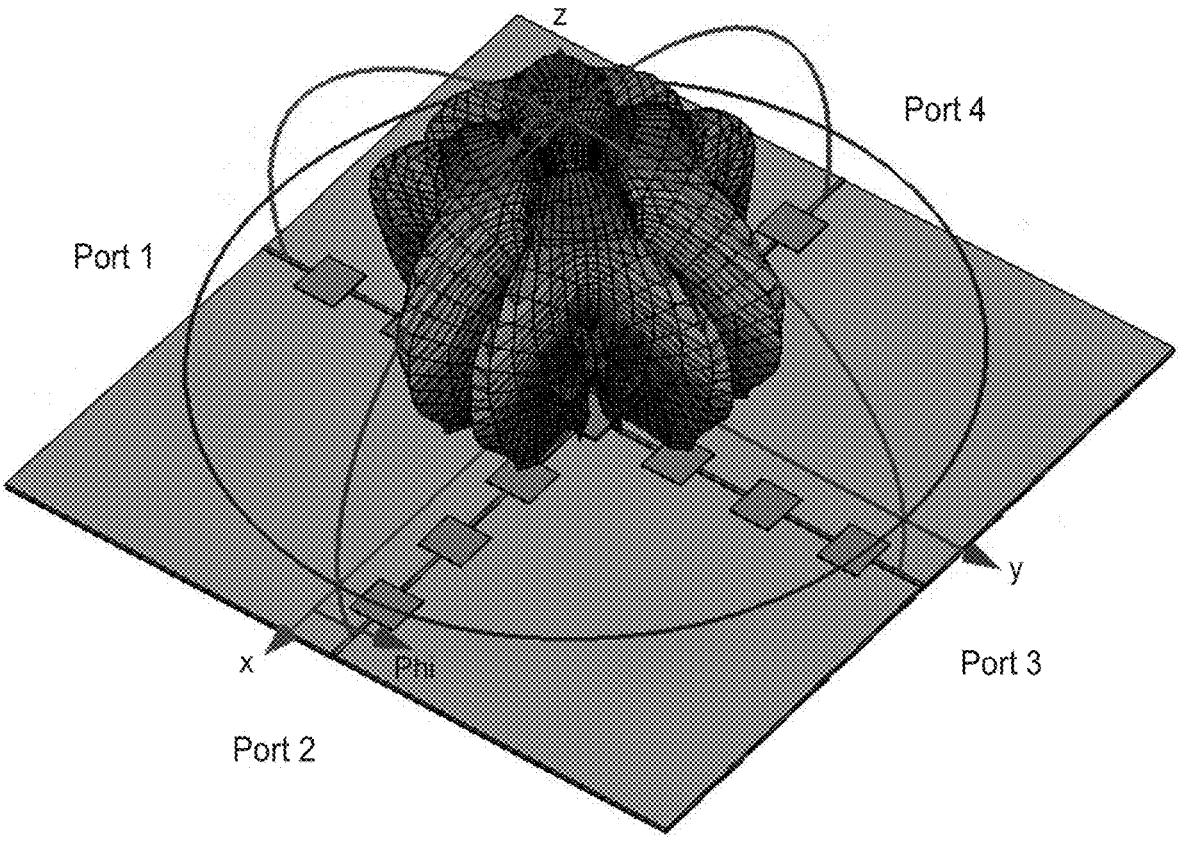
Figure 7:
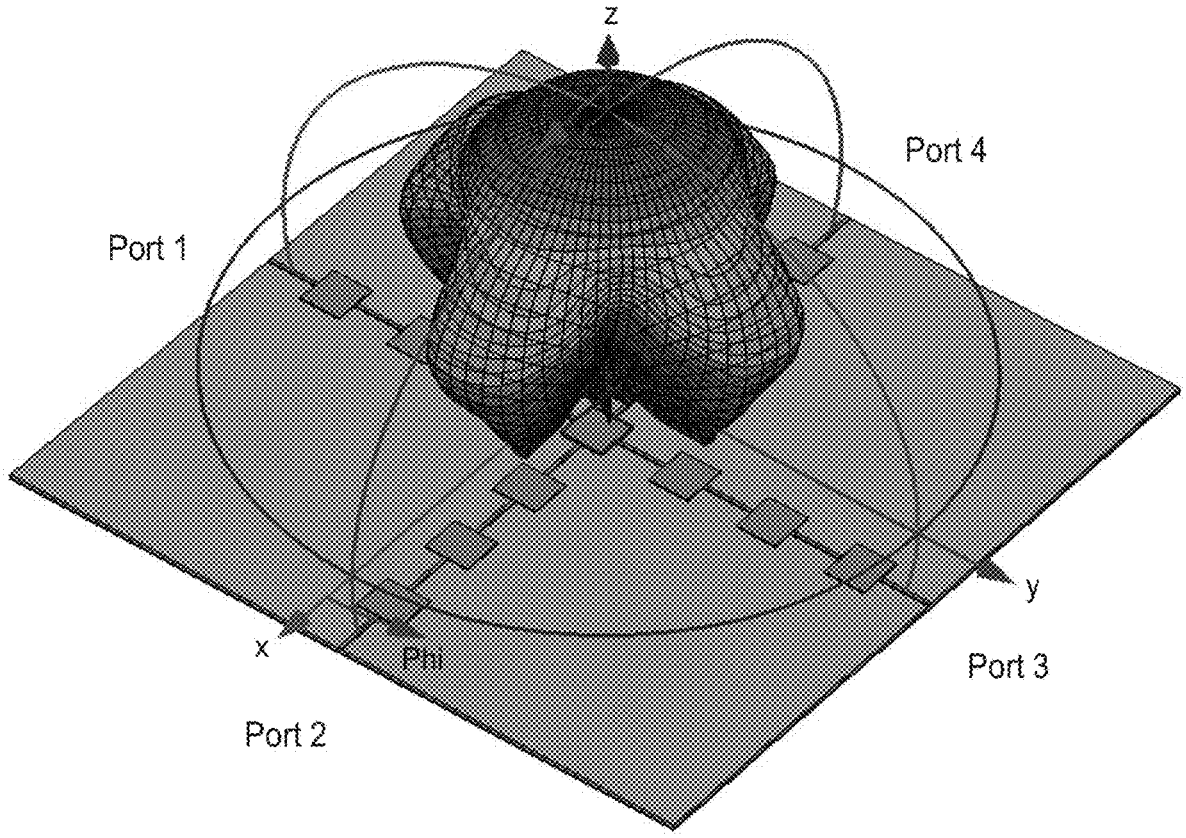
Figure 8:
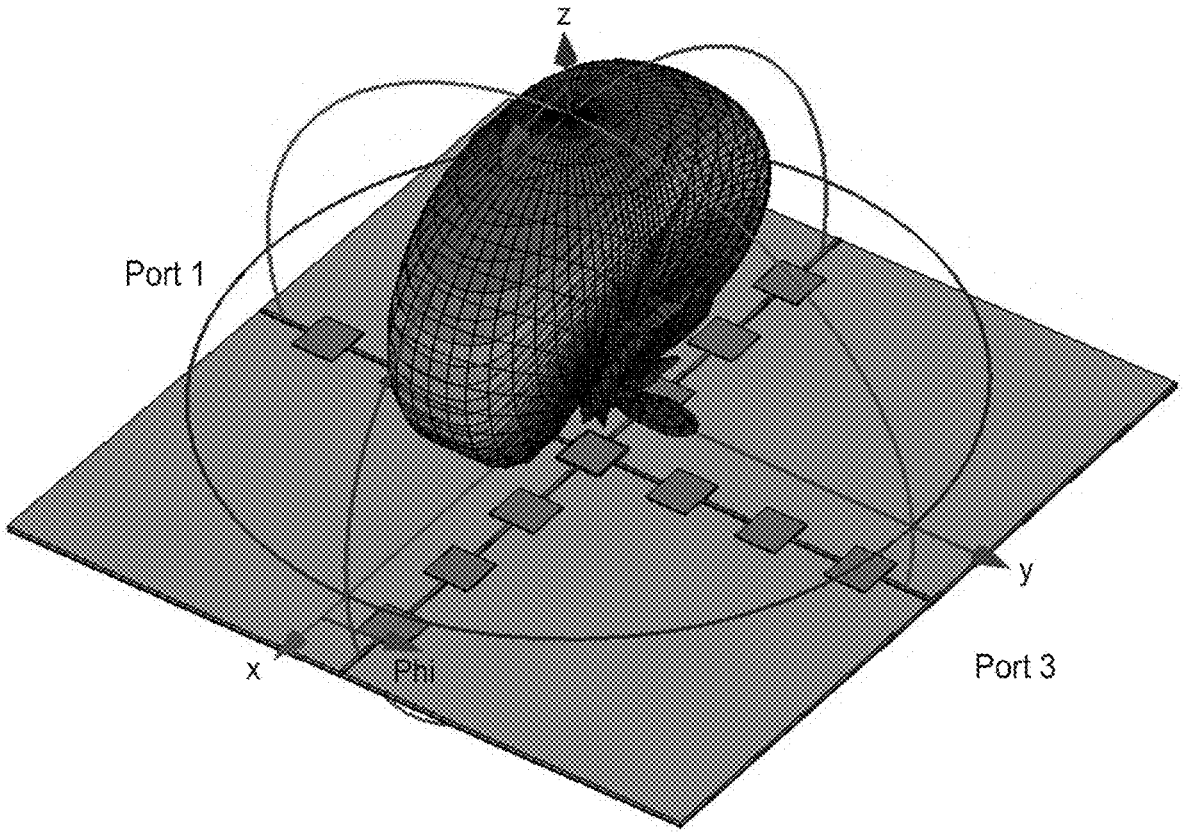
Figure 9:
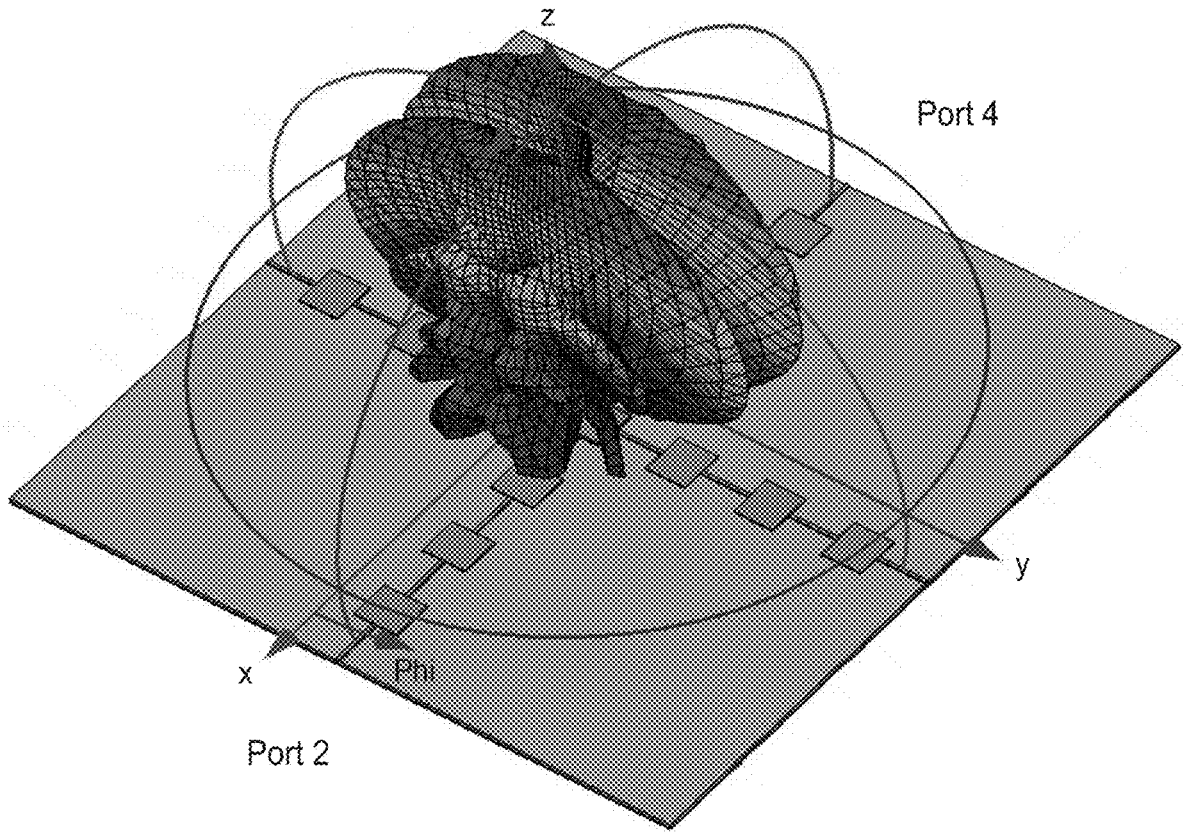

FIGS. 4 to 9 show exemplary antenna beam patterns achievable with the cross-shaped antenna array according to the present disclosure. FIG. 4 shows a tilted antenna beam in +y direction when port 1 is turned on. FIG. 5 shows an antenna beam tilted to −x/+y field if port 1 and port 2 are turned on at the same time and they have equal input phase and amplitude values. FIG. 6 shows a quad-beam antenna if all ports are turned on and phase difference between ports 1 and 3 on the one hand and ports 2 and 4 on the other hand is 180°. FIG. 7 shows an antenna beam looking to the broadside direction if all ports are turned on and phase difference between ports 1 and 4 on the one hand and ports 2 and 3 on the other hand is 180°. FIG. 8 shows a sum beam looking to the broadside direction if the signals are fed by port 1 and port 3 and the phase difference of the signals is 180°. FIG. 9 shows a dual-beam antenna beam directed to the −x and +x directions, if the signals fed by port 2 and port 4 have equal amplitude and phase values and the other two ports are matched.

Thus, the foregoing discussion discloses and describes merely exemplary embodiments of the present disclosure. As will be understood by those skilled in the art, the present disclosure may be embodied in other specific forms without departing from the spirit or essential characteristics thereof. Accordingly, the disclosure of the present disclosure is intended to be illustrative, but not limiting of the scope of the disclosure, as well as other claims. The disclosure, including any readily discernible variants of the teachings herein, defines, in part, the scope of the foregoing claim terminology such that no inventive subject matter is dedicated to the public.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

In so far as embodiments of the disclosure have been described as being implemented, at least in part, by software-controlled data processing apparatus, it will be appreciated that a non-transitory machine-readable medium carrying such software, such as an optical disk, a magnetic disk, semiconductor memory or the like, is also considered to represent an embodiment of the present disclosure. Further, such a software may also be distributed in other forms, such as via the Internet or other wired or wireless telecommunication systems.

The elements of the disclosed devices, apparatus and systems may be implemented by corresponding hardware and/or software elements, for instance appropriated circuits. A circuit is a structural assemblage of electronic components including conventional circuit elements, integrated circuits including application specific integrated circuits, standard integrated circuits, application specific standard products, and field programmable gate arrays. Further a circuit includes central processing units, graphics processing units, and microprocessors which are programmed or configured according to software code. A circuit does not include pure software, although a circuit includes the above-described hardware executing software.

It follows a list of further embodiments of the disclosed subject matter:

1. A cross-shaped antenna array comprising:

a first linear array (10) of first radiation elements (20), a second linear array (11) of second radiation elements (21), wherein said second linear array (11) is arranged substantially perpendicular to said first linear array (10), a common radiation element (22) arranged at the intersection (12) of said first linear array (10) and said second linear array (11), and a feed port (30, 31, 32, 33) at each end of said first and second linear arrays for reception of a feed signal.

2. The cross-shaped antenna array as defined in any preceding embodiment, wherein a first spacing (L20) between the respective first radiation elements (20) are all identical and a second spacing (L21) between the respective second radiation elements (21) are all identical.

3. The cross-shaped antenna array as defined in embodiment 2, wherein the first spacing (L20) is identical to the second spacing (L21).

4. The cross-shaped antenna array as defined in any preceding embodiment, wherein said radiation elements are patch antenna elements, slot antenna elements, slotted waveguide element or substrate-integrated waveguide elements.

5. An antenna device comprising:

a cross-shaped antenna array (1) as defined in any preceding embodiment, and a signal source (101) for generating a feed signal and for providing said feed signal to said feed ports (30, 31, 32, 33).

6. The antenna device as defined in embodiment 5, further comprising a controller (102) for controlling the providing of said feed signal to the respective feed ports (30, 31, 32, 33) and/or for switching the respective feed ports (30, 31, 32, 33) on and off.

7. The antenna device as defined in embodiment 5, further comprising a variable phase shifter (103) between said signal source (101) and at least one feed port (30, 31, 32, 33) to control the phase of the feed signal provided to the respective feed port.

8. The antenna device as defined in embodiment 5, further comprising a variable phase shifter (103) between said signal source (101) and each feed port (30, 31, 32, 33) to control the phase of the feed signal provided to the respective feed port.

9. The antenna device as defined in embodiment 7 or 8, wherein said variable phase shifter (103) is configured to shift the phase of the feed signal by 0° or 180°.

10. The antenna device as defined in embodiment 7 or 8, wherein said variable phase shifter (103) is configured to shift the phase of the feed signal to a shift value in the range from 0° to 360°.

11. The antenna device as defined in embodiment 9 or 10, further comprising a controller (102) for controlling the variable phase shifter (103).

12. A method of operating a cross-shaped antenna array as defined in any preceding embodiment, said method comprising:

generating a feed signal, providing said feed signal to one or more feed ports of said antenna array, thereby controlling to which of said feed ports the feed signal is provided and controlling the phase of the feed signal before providing it to said one or more feed ports.

13. The method as defined in embodiment 12, further comprising switching off a feed port to which no feed signal shall be provided.

14. The method as defined in embodiment 12 or 13, further comprising shifting the phase of the feed signal by 0° or 180°.

15. The method as defined in embodiment 12 or 13 further comprising shifting the phase of the feed signal to a shift value in the range from 0° to 360°.

The present application claims priority to European Patent Application 16 174 809.0, filed in the European Patent Office on 16 Jun. 2016, the entire contents of which being incorporated herein by reference.

The invention claimed is:

1. A cross-shaped antenna array comprising:

a first linear array of first radiation elements, a second linear array of second radiation elements, wherein said second linear array is arranged substantially perpendicular to said first linear array, a common radiation element arranged at the intersection of said first linear array and said second linear array, a feed port at each end of said first and second linear arrays for reception of a feed signal from a signal source, such that the cross-shaped antenna array comprises four of said feed ports, and a variable phase shifter between said signal source and at least one feed port to control the phase of the feed signal provided to the respective feed port, wherein in the first linear array, the first radiation elements and the common radiation element are connected in series between the feed ports of the first linear array such that the first radiation elements, the common radiation element, the feed ports of the first linear array, and the variable phase shifter are connected in series;

in the second linear array, the second radiation elements and the common radiation element are connected in series between the feed ports of the second linear array; and the cross-shaped antenna array is configured to allow all radiation elements in the cross-shaped antenna array to be connected to the signal source using only the four feed ports.

2. The cross-shaped antenna array as claimed in claim 1, wherein a first spacing between the respective first radiation elements are all identical and a second spacing between the respective second radiation elements are all identical.

3. The cross-shaped antenna array as claimed in claim 2, wherein the first spacing is identical to the second spacing.

4. The cross-shaped antenna array as claimed in claim 1, wherein said radiation elements are patch antenna elements, slot antenna elements, slotted waveguide element or substrate-integrated waveguide elements.

5. An antenna device comprising:

a cross-shaped antenna array as claimed in claim 1, and a signal source for generating a feed signal and for providing said feed signal to said feed ports.

6. The antenna device as claimed in claim 5, further comprising a controller for controlling the providing of said feed signal to the respective feed ports and/or for switching the respective feed ports on and off.

7. The antenna device as claimed in claim 5, further comprising a variable phase shifter between said signal source and each teed port to control the phase of the feed signal provided to the respective feed port.

8. The antenna device as claimed in claim 1, wherein said variable phase shifter is configured to shift the phase of the feed signal by 0° or 180°.

9. The antenna device as claimed in claim wherein said variable phase shifter is configured to shift the phase of the feed signal to a shift value in the range from 0° to 360°.

10. The antenna device as claimed in claim 8, further comprising a controller for controlling the variable phase shifter.

11. A method of operating a cross-shaped antenna array as claimed in claim 1, said method comprising generating a feed signal, providing said feed signal to one or more feed ports of said antenna array, thereby controlling to which of said feed ports the feed signal is provided and controlling the phase of the feed signal before providing it to said one or more feed ports.

12. The method as claimed in claim 11, further comprising switching off a feed port to which no feed signal shall be provided.

13. The method as claimed in claim 11, further comprising shifting the phase of the feed signal by 0° or 180°.

14. The method as claimed in claim 11, further comprising shifting the phase of the feed signal to a shift value in the range from 0° to 360°.

* * * * *